US008109454B2

(12) United States Patent
Lehtonen et al.

(10) Patent No.: US 8,109,454 B2
(45) Date of Patent: Feb. 7, 2012

(54) CRUSHER, METHOD FOR CRUSHING MATERIAL AND METHOD FOR CONTROLLING A CRUSHER

(75) Inventors: Harri Lehtonen, Pirkkala (FI); Keijo Viilo, Tampere (FI)

(73) Assignee: Metso Minerals Inc., Helsinki (FI)

( * ) Notice: Subject to any disclaimer, the term of this patent is extended or adjusted under 35 U.S.C. 154(b) by 148 days.

(21) Appl. No.: 12/451,793

(22) PCT Filed: Jun. 7, 2007

(86) PCT No.: PCT/FI2007/050335

§ 371 (c)(1), (2), (4) Date: Dec. 1, 2009

(87) PCT Pub. No.: WO2008/148928

PCT Pub. Date: Dec. 11, 2008

(65) Prior Publication Data

US 2010/0163657 A1 Jul. 1, 2010

(51) Int. Cl.
*B02C 2/00* (2006.01)

(52) U.S. Cl. ..... 241/30; 241/205; 241/206; 241/261.1

(58) Field of Classification Search ..... 241/205, 241/30, 253, 206, 261.1
See application file for complete search history.

(56) References Cited

U.S. PATENT DOCUMENTS

| | | | |
|---|---|---|---|
| 3,627,214 | A | 12/1971 | Hilbrands |
| 2006/0243833 | A1 | 11/2006 | Nilsson |

FOREIGN PATENT DOCUMENTS

| | | | |
|---|---|---|---|
| GB | 689453 | | 3/1953 |
| RU | 2 145 521 | | 2/2000 |
| SU | 1477462 | A1 | 5/1989 |
| WO | WO 2005/102530 | A1 | 11/2005 |

OTHER PUBLICATIONS

International Search Report issued in International Application No. PCT/FI2007/050335; Feb. 26, 2008.

*Primary Examiner* — Mark Rosenbaum
(74) *Attorney, Agent, or Firm* — Oliff & Berridge, PLC

(57) ABSTRACT

A crusher comprising at least a first crushing blade and a second crushing blade which are arranged to be rotary, one of the crushing blades being also arranged to move back and forth along a substantially harmonic linear path, and the rotating axes of the first crushing blade and the second crushing blade being parallel with the linear direction of movement of the second crushing blade. The second crushing blade is adjusted to move substantially harmonically back and forth along a linear path.

15 Claims, 5 Drawing Sheets

CRUSHER, METHOD FOR CRUSHING MATERIAL AND METHOD FOR CONTROLLING A CRUSHER

FIELD OF THE INVENTION

The invention relates to a crusher. The invention also relates to a method for crushing material and a method for controlling a crusher.

BACKGROUND OF THE INVENTION

Crushers are used for crushing solid pieces to a smaller size. Typically, a piece to be crushed is introduced between two crushing blades moving in relation to each other, their movement crushing the piece. Patent document U.S. Pat. No. 3,627,214 describes a crusher, in which a lower crushing blade moving linearly back and forth by means of hydraulics is used for crushing. Further, the upper and lower crushing blades of the crusher are brought into a rotary movement in the horizontal plane. In the presented solution, the material to be crushed is fed into the crusher from the top, from where the material is carried off between the crushing blades by the centrifugal force generated by the rotary crushing blades. By applying the centrifugal force, it is possible to increase the capacity of the crusher.

BRIEF SUMMARY OF THE INVENTION

Now, a solution has been invented for improving significantly the properties of the above-described crusher of prior art.

To achieve this aim, the crusher according to the invention is primarily characterized in what will be presented in the independent claim 1. The method according to the invention is, in turn, primarily characterized in what will be presented in the independent claim 9. The method for controlling a crusher according to the invention is, in turn, primarily characterized in what will be presented in the independent claim 14. The other, dependent claims will present some preferred embodiments of the invention.

The crusher according to the basic idea of the invention comprises first and second crushing blades fitted to rotate with respect to a rotation axis. Furthermore, the second crushing blade is fitted to move back and forth along a linear path which is parallel to the rotation axis. The linear movement of the second crushing blade is substantially harmonic; that is, when the direction of movement is changed, the speed of movement is accelerated under control to a maximum speed, after which the speed is decelerated under control before the change in the direction of movement.

The harmonic movement exerts considerably smaller loads on the structures than such a back-and-forth movement that is not decelerated before a change in the direction of movement. This has an advantageous effect on the durability and/or the dimensions of the crusher.

In an advantageous embodiment, the linear and substantially harmonic movement of the second crushing blade is effected by an eccentric. In one embodiment, the movement of the eccentric shaft is transmitted to the second crushing blade by means of a slide. In another embodiment, the movement of the eccentric shaft is transmitted to the second crushing blade by means of a connecting rod.

In one advantageous embodiment, the crushing blades are arranged so that the first crushing blade is up and the second crushing blade is down. Thus, the linear movement of the crusher changes the gap between the lower surface of the first crushing blade and the upper surface of the second crushing blade. The magnitude of the gap varies in a substantially harmonic way.

The different embodiments of the above-described arrangement, taken separately and in various combinations, provide several advantages. An advantage of one embodiment of the invention to a conventional crusher is the 4 to 5 times faster crushing function, which is effected by increasing the acceleration of the material to be crushed in the gap.

The chamber performance of conventional crushers is limited by the earth's gravity which dominates the movement of the material in the crushing space and thereby limits the crushing speed to 250 to 400 crushing functions per minute. With a crusher according to the invention, it is possible to achieve 1000 to 1500 crushing functions per minute, depending on the size of the application.

The solution according to the invention prepares the way for crushers with a high performance in relation to the weight. A crusher according to the invention which is slightly more efficient than a conventional cone crusher of 5,400 kg weighs about 3,100 kg. Furthermore, thanks to its smaller outer dimensions, it can be placed more easily in movable crushing plants. The small weight and dimensions of the crusher in relation to its performance also provides an obvious advantage of cost efficiency.

Also, the adjustability of the crusher is substantially improved by a new control parameter, i.e. the speed of rotation of the chamber. Changing the speed of rotation of the crushing chamber is a decisive and easy way to affect such variables important for the crushing as the stroke, the compression ratio, the chamber density, and the number of crushing zones, whereby the operation of the crusher can be easily optimized for different uses, if necessary. For example in mining crushers, the aim may be a crushing ratio that is clearly greater than at present.

Furthermore, in the solution according to the invention, the frame structures of the crusher are substantially subjected to a force in the direction of the linear movement. Thus, the provision of an adjusting/safety device for the setting of the crusher is decisively easier than in conventional cone crushers with a gyratory crushing force.

Providing the apparatus with mechanical power transmission will result in a good efficiency that is substantially higher than with hydraulic arrangements. It is thus more economical to use the apparatus, and also the power input required by the crusher is smaller than in hydraulic apparatuses.

DESCRIPTION OF THE DRAWINGS

In the following, the invention will be described in more detail with reference to the appended principle drawings, in which.

For the sake of clarity, the drawings only show the details necessary for understanding the invention. The structures and details that are not necessary for understanding the invention but are obvious for anyone skilled in the art have been omitted from the figures in order to emphasize the characteristics of the invention.

DETAILED DESCRIPTION OF THE INVENTION

The crusher according to the invention can be implemented in a variety of ways. An advantageous embodiment which can be varied in a number of ways is used as an example. The crusher according to the example is substantially vertical so that the material to be crushed is supplied from above via a funnel-shaped structure and the material flow proceeds downwards. The crusher may also be in another position, but the position according to the example is often advantageous with respect to the control of the material flow.

Figure 1:
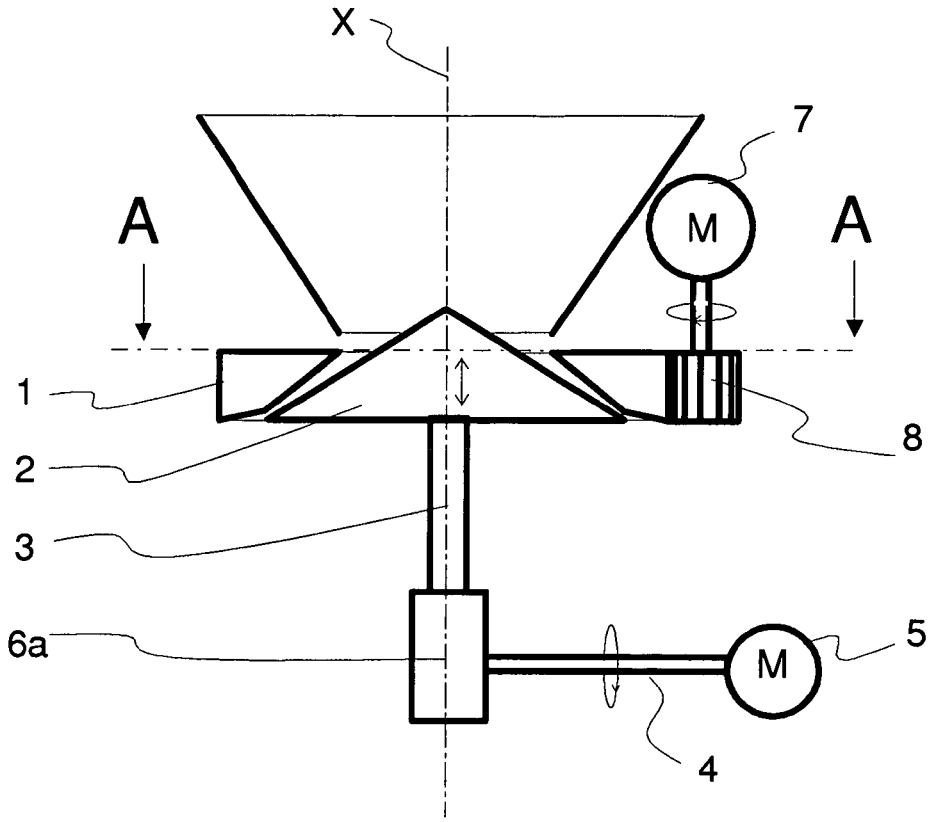
FIG. 1 shows a cross-sectional reduced view of the principle of a crusher according to the invention.
Figure 2:
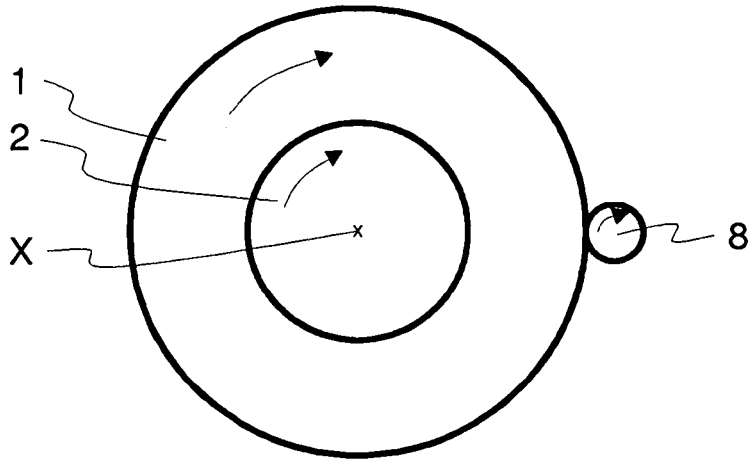
FIG. 2 shows a section along line A-A in FIG. 1.

FIG. 1 shows, in a very simplified side view, the structure of a crusher according to the invention, comprising at least a first crushing blade 1 and a second crushing blade 2 which are arranged to be rotary, one of the crushing blades being also arranged to move back and forth along a substantially harmonic linear path. The rotation axes X of the first crushing blade 1 and the second crushing blade 2 are parallel with the linear direction of movement of the second crushing blade 2. FIG. 2 illustrates the rotation of the crushing blades 1, 2 seen from above, i.e. from the direction of supplying the material.

The crushing unit shown in FIG. 1 comprises a vertical main shaft 3. An element called the lower crushing blade 2 and used as a wearing part is connected to the main shaft 3. The lower crushing blade 2 is surrounded by the frame of the crusher. The frame consists of two parts: an upper frame and a lower frame, which are movable in relation to each other. The lower crushing blade 2 is connected to the lower frame. Another element, called the upper crushing blade 1 and used as a wearing part, is, in turn, connected to the upper frame. The upper crushing blade 1, or the outer crushing blade, corresponds in this example to the first crushing blade 1. The lower crushing blade 2, or the inner crushing blade, corresponds in this example to the second crushing blade 2.

Together, the lower crushing blade 2 and the upper crushing blade 1 constitute a crushing chamber in which the feed material, such as rock or construction waste, is crushed. In the crusher according to the invention, the distance between the opposite surfaces of the crushing blades 1, 2 in the crushing chamber is first large and then becomes smaller, seen in the direction in which the material flow to be crushed proceeds. The angle between the crushing blades 1, 2 is preferably about 10 to 30°. Furthermore, the perpendicular distance of the central axis from the surfaces of the crushing chamber increases in the direction in which the material flow proceeds. As the distance increases, the surface area of the blades increases as well. Thus, in different crushing zones, it is possible to maintain the same volume or to have the change of the volume under control. In an advantageous embodiment, the volumes of the different crushing zones are substantially equal; that is, when the gap between the crushing blades 1, 2 decreases, the surface area of the crushing zone increases in relation to the reduction of the gap. This feature has an advantageous effect on crushing.

In one embodiment, the inner surface of the first crushing blade 1 and the outer surface of the second crushing blade 2 are advantageously substantially conical in shape, such as cones or truncated cones whose outer surface is provided with a suitable crushing embossing, such as grooves, teeth or other protrusions and/or recessions. In the example of FIG. 1, the second crushing blade 2 becomes wider in the direction in which the material flow proceeds; that is, in the example, the diameter of the lower part of the second crushing blade is larger than the diameter of the upper part. The crushing blades 1, 2 may also have other shapes, and they may comprise, for example, convex, concave and/or straight portions. The shape of the crushing blade 1, 2 is influenced by a number of factors, such as running speeds, material flows, and the properties of the material to be crushed. By the shapes of the crushing blades 1, 2 it is possible to affect the operation of the crushing chamber.

The main shaft 3 is arranged to move back and forth along a linear path. In the example, the movement is a movement up and down. Thus, the gap between the second or lower crushing blade 2 and the first or upper crushing blade 1 varies during the cycle. The back and forth movement is continuous, and in one embodiment, the reciprocating movement takes place several times a second. For example, in one embodiment, the reciprocating movement takes place 15 to 25 times a second.

Herein, the harmonic movement of the crushing blade 2 means a movement in which, the crushing blade moving between the extreme positions, the movement of the crushing blade in relation to time can be illustrated by a graph which is substantially sinusoidal. When the direction of movement of the crushing blade 2 is changed, the speed of movement is accelerated under control to the maximum speed, after which the speed is decelerated under control before the direction of movement is changed. By the harmonic movement, the structures of the crusher are subjected to considerably smaller loads than by such a reciprocating movement whose speed is not changed in a controlled manner in connection with a change of direction.

The linear crushing movement can be effected in a variety of ways. In the advantageous embodiment shown in the example, the linear or vertical crushing movement is effected by means of a horizontal eccentric shaft 4. The power for the movement is generated by a suitable actuator 5, such as an electric or hydraulic motor. The eccentric shaft 4 is rotated by a suitable actuator 5, by means a power transmission structure, if necessary. For example, the eccentric shaft 4 can be driven by a motor 5 by means of belt transmission. It is also possible to use, for example, a shaft, a hydraulic line and/or a gear as the power transmission structure. In the examples shown in FIGS. 3 and 8, the eccentric shaft 4 is coupled, by means of a slide 6*a* mounted on bearings, to a piston-like main shaft 3 performing a harmonic vertical motion. When the eccentric shaft 4 is rotated, the main shaft 3 and thereby the second crushing blade 2 are entrained in a harmonic linear vertical movement, wherein the gap between the first crushing blade 1 and the second crushing blade 2 varies during the cycle. The length of the linear movement is typically about 10 to 30 mm, but the length of the movement may also be different, depending on the application.

Figure 4:
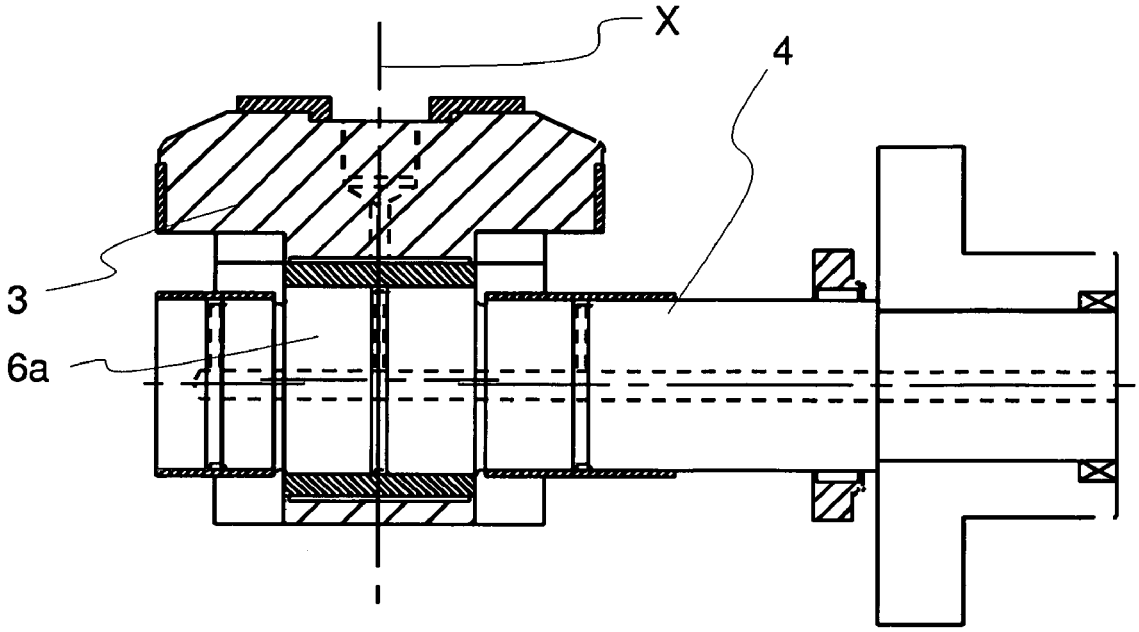
FIG. 4 shows an embodiment of an eccentric shaft and a slide.
Figure 5:
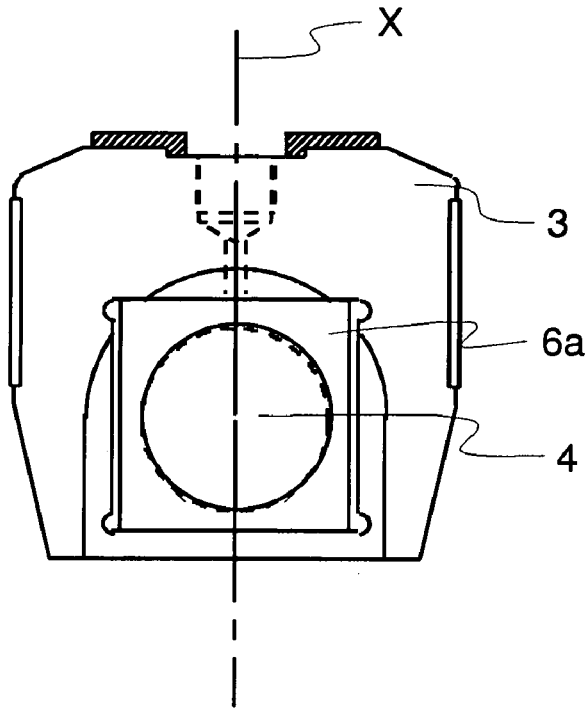
FIG. 5 shows the slide according to FIG. 4 in the cross direction.

The eccentric shaft 4 and the slide 6*a* are shown in more detail in FIGS. 4 and 5. The slide 6*a* is connected to the main shaft 3 so that the slide cannot move with respect to the main shaft in the direction of the axis of the main shaft. Thus, when the slide 6*a* moves so that the movement comprises a component parallel to the axis of the main shaft 3, the main shaft also moves in the direction of its axis. Advantageously, the slide 6*a* may move with respect to the main shaft 3 in a direction perpendicular to the axial line of the main shaft.

In the structure according to the example, the slide 6*a* transmits both an upward movement and a downward movement to the main shaft 3. In the example, the slide 6*a* can move in the horizontal direction with respect to the main shaft 3. However, the slide 6*a* cannot move in the direction of the axis of the main shaft with respect to the main shaft 3. Thus, when the eccentric shaft 4 moves the slide 6*a* upwards, the main shaft 3 is moved upwards as well. In a corresponding manner, when the eccentric shaft 4 moves the slide 6*a* downwards, the main shaft 3 is moved downwards as well. The slide 6*a* does not cause movements of the main shaft 3 in a direction parallel to the axial line of the main shaft, that is, horizontal movements in the example.

Figure 6:
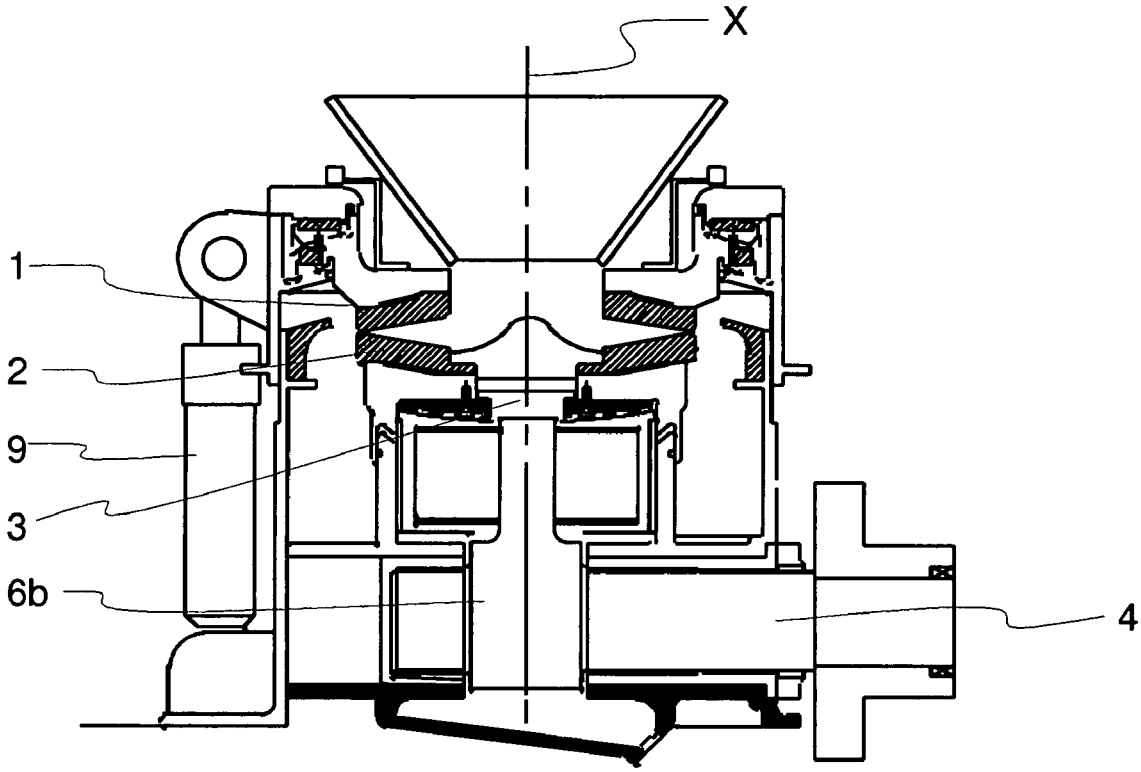
FIG. 6 shows an embodiment of an eccentric shaft and a connecting rod.
Figure 7:
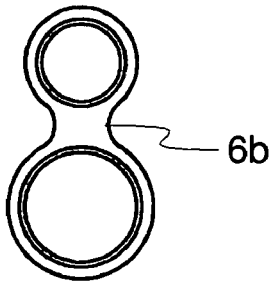
FIG. 7 shows the connecting rod according to FIG. 6 in the cross direction.

In the embodiment shown in FIG. 6, the movement of the eccentric shaft 4 is transmitted to the second crushing blade 2 by means of a connecting rod 6*b*. In the structure according to the example, the connecting rod 6*a* transmits both an upward movement and a downward movement to the main shaft 3. The connecting rod 6*a* does not cause movements of the main shaft 3 in a direction perpendicular to the axial line of the main shaft, that is, horizontal movements in the example. FIG. 7 shows an embodiment of the connecting rod 6*b* seen in the direction of the axis of the eccentric shaft 4.

The presented use of the eccentric shaft 4 and the slide 6*a* or the connecting rod 6*b* forces the crushing blade 2 connected to the slide or the connecting rod to move linearly from one extreme position to another according to the movement of the eccentric shaft. The eccentric shaft 4 causes a constrained back-and-forth linear movement of the crushing blade 2 during a cycle. Such a structure does not require separate pullback structures for returning the crushing blade 2 from the other extreme position. The pullback structure could be, for example, a spring that would return the crushing blade 2 down. The tensioning of such a spring would require extra work which, in turn, would impair the efficiency, for which reason it is advantageous not to use a separate pullback structure when the aim is to achieve a high efficiency.

Figure 3:
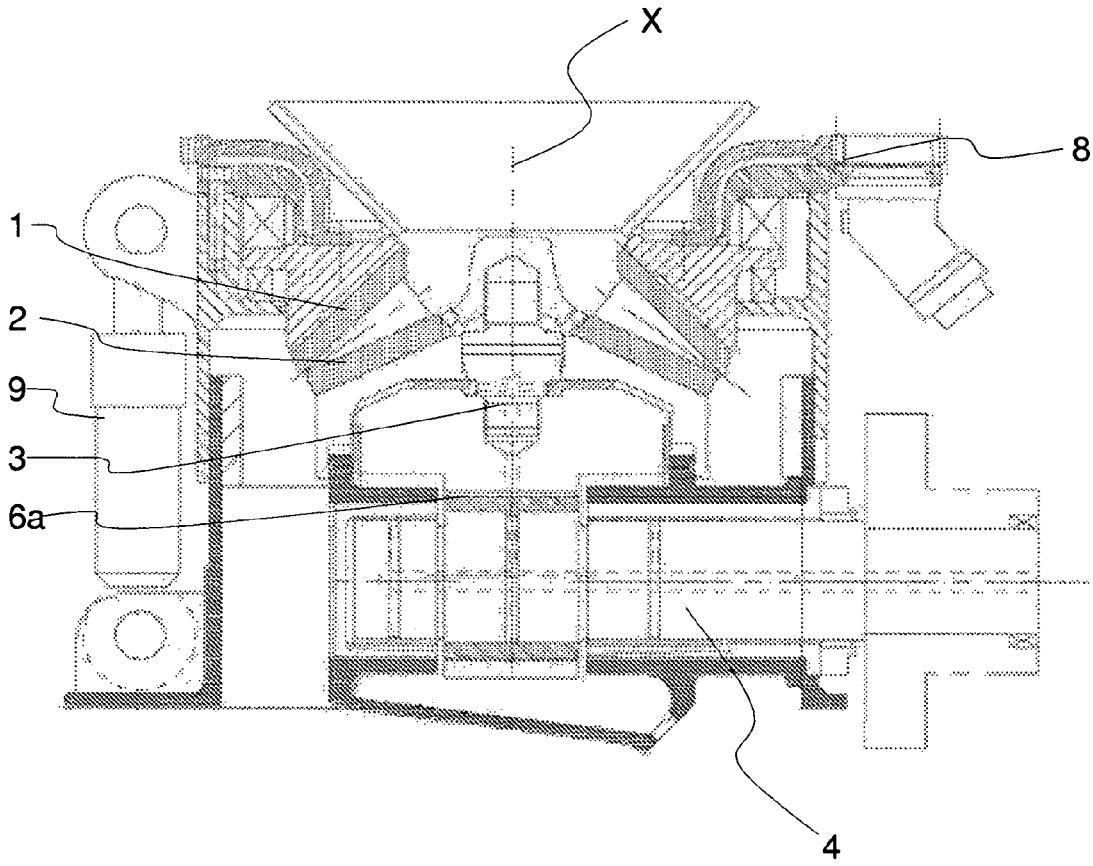
FIG. 3 shows an embodiment of a crusher.

The first crushing blade 1 and the second crushing blade 2 of the crusher are rotary, and their rotation axes X are parallel with the direction of the linear movement of the second crushing blade 2. In the example, the first crushing blade 1 rotates in the horizontal direction around a vertical central axis X. In the example of FIG. 3, the first or upper crushing blade 1 of the crusher is mounted on bearings on the vertically movable upper frame of the crusher by means of grease-lubricated axial roller and ball bearings. The rotary movement is transmitted from an actuator 7 (for example a hydraulic motor) by means of power transmission 8 (for example a toothed rim or belt transmission) to the first crushing blade 1. The actuator 7 can also be another device, such as an electric motor. In view of the operation of the crusher, it is advantageous that the speed of rotation of the crushing blade 1 is easily adjustable. In one embodiment, the rotation speed of the crushing blade 1 is about 100 to 200 revolutions per minute.

The rotating power for the second crushing blade 2 can be generated by dedicated actuators and/or power transmission structures, or the rotating power can be generated by other actuators. For example, the rotating power for both of the crushing blades 1, 2 can be generated by single actuators 7, from which the rotating power is transmitted by suitable structures to both crushing blades. In an advantageous embodiment, the rotating power is generated by an actuator 7 for the first crushing blade 1, and the rotating power required for rotating the second crushing blade 2 is transmitted from the first crushing blade 1 to the second crushing blade 2 during the compressing movement of crushing. During the compressing movement, the first crushing blade 1 and the second crushing blade 2 are connected to each other by means of the material to be crushed between them. Thus, the material to be crushed and the second crushing blade 2 receive substantially the speed and the acceleration of the rotating movement effective on the first crushing blade 1.

In the application used as an example, the second crushing blade 2 is mounted on slide bearings to rotate freely with respect to the slide 6*a* or the connecting rod 6*b* and the main shaft 3, wherein the second crushing blade can rotate with the first crushing blade 1. In the example, the bearings of the second crushing blade 2 are lubricated via a lubricating channel extending through the eccentric shaft 4, and oil is discharged by gravity via an oil duct under the eccentric shaft to an oil tank. Preferably, the second crushing blade 2 is adapted to rotate so that its rotation axis X is parallel with the linear direction of movement. In the example, the second crushing blade 2 rotates in the horizontal plane around the vertical central axis X, as can be seen from FIG. 2. Preferably, the first crushing blade 1 and the second crushing blade 2 have the same rotation axis; that is, the crushing blades rotate concentrically. Preferably, the rotation axes are at the central axes X of the crushing blades 1, 2, wherein the first crushing blade 1 rotates around the central axis X of the first crushing blade, and the second crushing blade 2 rotates around the central axis X of the second crushing blade.

The rotary movement of the crushing blades 1, 2 generates a centrifugal force on the material to be crushed. Thus, the material is affected by the centrifugal force in addition to the earth's gravity. The centrifugal force has an advantageous effect on the crushing efficiency, because it accelerates the passage of the material away from the rotation axis/central axis X. The material flow passes between the crushing blades 1, 2 of the crusher outwards from the central axis X. Compared to conventional crushers, the material to be crushed in the crushing chamber is subjected to a 5 to 13 times greater acceleration.

The flow of the material to be crushed between the crushing blades 1, is also affected by the angles of the crushing blades. Advantageously, the surface of the first crushing blade 1 is at a right angle to the rotation axis X and the linear crushing movement. The surface of the first crushing blade 1 may also be at another angle to the rotation axis X and the linear crushing movement. For example, it may be at an angle of about 75 to 90° to the rotation axis and the linear crushing movement so that the perpendicular distance of the rotation axis from the surface of the crushing blade increases, seen from the direction of supplying the material to be crushed.

The surface of the second crushing blade 2 may be at a right angle to the rotation axis X and the linear crushing movement, or the surface may be at different angles to the rotation axis X and the linear crushing movement. The suitable angle of the surface of the second crushing blade 2 is influenced, inter alia, by the angle of the surface of the first crushing blade 1 and the rotation speed of the crushing blades 1, 2, as well as the desired path and speed of propagation of the material to be crushed. It is advisable to select the angles of the crushing blades 1, 2 according to the material to be crushed and the crushing speed. Preferably, the angle between the opposite surfaces of the first crushing blade 1 and the second crushing blade 2 is about 10 to 30°.

Figure 8:
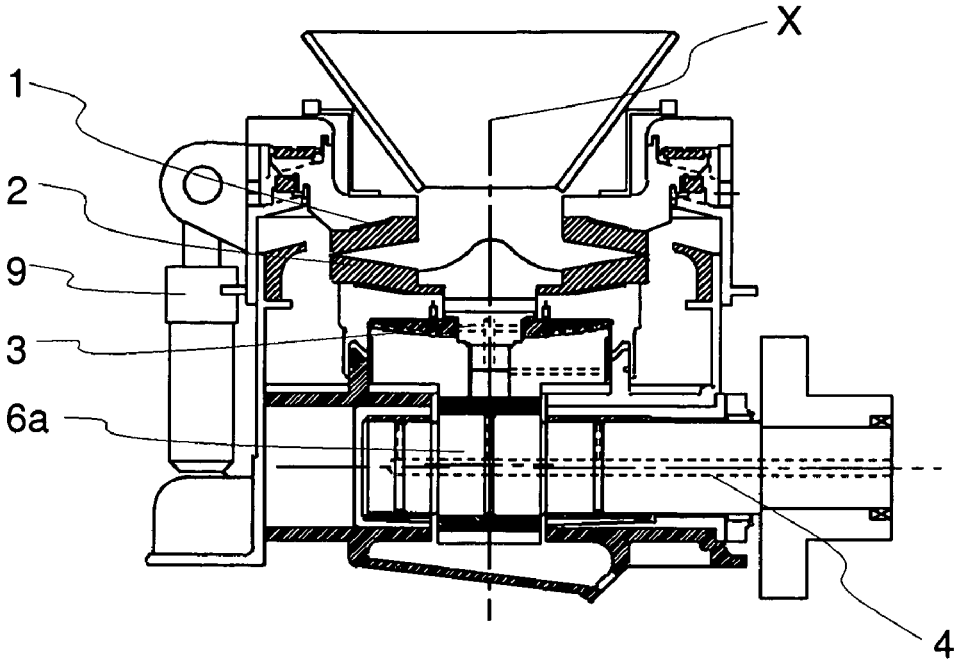
FIG. 8 shows another embodiment of the crusher.

In the example of FIG. 8, the conical surfaces of the crushing blades 1, 2 are at angles oblique in different directions with respect to the rotation axis X. The surface of the first crushing blade 1 is at an angle of about 75° to the rotation axis X and the linear crushing movement. The surface of the second crushing blade, in turn, is at an angle of about 75° to the rotation axis X and the linear crushing movement. The central line of the crushing chamber is, in the example, substantially perpendicular to the rotation axis X, and the angle between the first crushing blade 1 and the second crushing blade 2 is about 30°. The inclination of the crushing blades 1, 2 shown in FIG. 8 is suitable, for example, for stone crusher applications, in which the rotation speed of the crushing blades is high, for example 100 to 200 revolutions per minute.

In the example of FIG. 3, the conical surfaces of the crushing blades 1, 2 are at angles oblique in the same direction with respect to the rotation axis X. The surface of the first crushing blade 1 is at an angle of about 45° to the rotation axis X and the linear crushing movement. The surface of the second crushing blade is, in turn, at an angle of about 70° to the rotation axis X and the linear crushing movement. The central line of the crushing chamber is, in the example, at an angle of about 50°, and the angle between the first crushing blade 1 and the second crushing blade 2 is about 20°. Advantageously, the first crushing blade 1 is at an angle of about 45 to 70° to the rotation axis X, and the second crushing blade 2 is at an angle of about 55 to 80° to the rotation axis. At smaller angles and smaller rotation speeds, it is possible to increase the effect of gravity on the passage of the material flow, and, correspondingly, at greater angles and greater rotation speeds, the effect of the centrifugal force on the passage of the material flow increases. The inclination of the crushing blades 1, 2 shown in FIG. 3 is suitable, for example, for stone crusher applications, in which the rotation speed of the crushing blades is low, for example 60 to 100 revolutions per minute.

In one embodiment, the surface of the first crushing blade 1 is at a perpendicular angle to the rotation axis. The surface of the second crushing blade 2 is, in turn, at an oblique angle to the rotation axis X. The surface of the second crushing blade 2 is at an angle of about 70° to the rotation axis X and the linear crushing movement. The distance of the first crushing blade 1, in the direction of the rotation axis X, from the surface of the second crushing blade 2 is greater in the vicinity of the material input than farther away from the material input. In other words, the distance of the first crushing blade 1, in the direction of the rotation axis X, from the surface of the second crushing blade 2 reduces, seen from the direction of feeding of the material to be crushed. The angle between the first crushing blade 1 and the second crushing blade 2 is about 20°.

Figure 9:
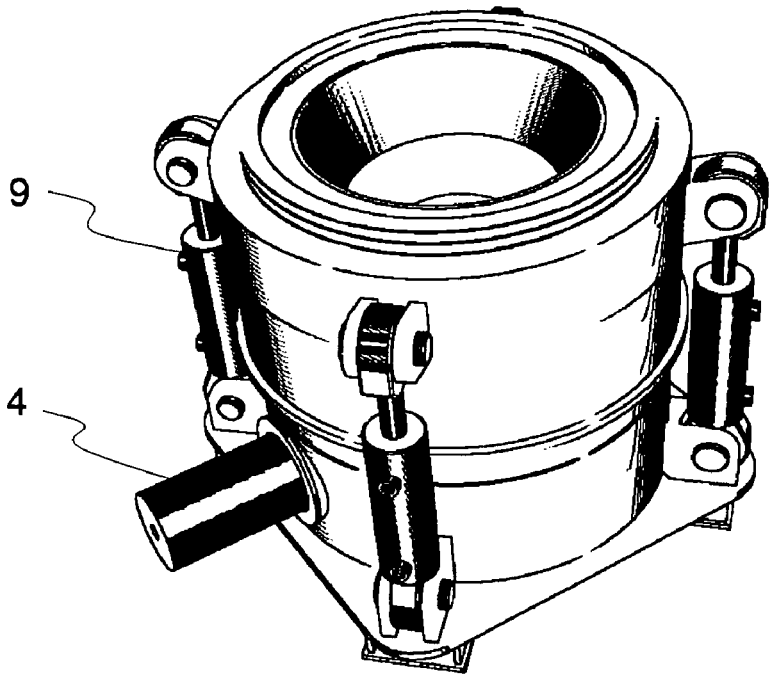
FIG. 9 is a perspective view showing an embodiment of a crusher with the control cylinders visible.

The upper frame of the crusher is advantageously movable with respect to the lower frame. In the examples of FIGS. 3 and 8, the upper frame is mounted to the lower frame by four hydraulic cylinders 9 (all the cylinders are not shown in the figure) which receive the crushing force. FIG. 9 is a perspective view showing the placement of the control cylinders 9 in a crusher. In the example, the four control cylinders 9 connect the upper frame and the lower frame of the crusher. There may also be more or fewer control cylinders 9 than in the example. The number of cylinders is also influenced, inter alia, by the size of the application and the properties of the control cylinders 9 used. By the cylinders 9, it is possible to adjust the setting of the crusher steplessly upon crushing, and they can be provided with an overload protection device and a device for removing an uncrushable solid object, such as a piece of iron. In the crusher according to the example, the crushing force has vertical and horizontal components. The horizontal components of the crushing force effective on the frame structures substantially compensate for each other. The frame structures are thus essentially subjected to the force effective in the direction of the linear movement, that is, the vertical force in the example. Because the force is substantially parallel to the direction of movement of the cylinders, the typical control cylinders 9 stand said force, wherein no separate locking structures will be needed. Thus, it is decisively easier to provide a device for adjusting the setting and/or a safety device for the crusher than for conventional crushers with a rotary crushing force. Furthermore, it is possible to adjust the crusher by the control cylinders 9 during the operation, because the setting of the crusher does not need to be locked by separate locking structures for the time of the operation. The control cylinders 9 can also be provided with a safeguarding property, wherein the cylinders allow the crushing blades 1, 2 to draw away from each other, when there is material between them that cannot be crushed by the crushing blades.

The above-presented arrangement also makes it possible to control the crusher in a new way. The adjustability of the crusher is substantially improved because of a new control parameter, i.e. the speed of rotation of the chamber. The smallest gap occurring during the cycle is called the setting of the crusher, and the difference between the maximum and the minimum of the gap is called the stroke of the crusher. Typically, the crusher is adjusted by changing the setting and the stroke. By changing the rotation speed of the crushing chamber, it is easy to affect the factors important for the crushing. For example, a variable affected by the rotation speed may be the stroke, the compression ratio, the chamber density and/or the number of crushing zones. By adjusting the variables, the operation of the crusher can be optimized, if necessary, for different uses. By the crusher setting and the crusher stroke, the operating speed of the crusher and the rotation speed of the crushing chamber, it is possible, among other things, to influence the grain size distribution of the crushed material and the production capacity of the crusher. The adjustment of the crusher can be based solely on the adjustment of the rotation speed of the crushing chamber, or it can be combined with other ways of adjustment.

In the above-presented embodiments, the crushing blade fitted to perform a harmonic back-and-forth linear movement is the one placed lower in the direction of the material flow. It is also possible to implement the crusher so that the first, upper crushing blade in the direction of the material flow is arranged to perform a linear movement.

By combining, in various ways, the modes and structures disclosed in connection with the different embodiments of the invention presented above, it is possible to produce various embodiments of the invention in accordance with the spirit of the invention. Therefore, the above-presented examples must not be interpreted as restrictive to the invention, but the embodiments of the invention may be freely varied within the scope of the inventive features presented in the claims hereinbelow.

The invention claimed is:

1. A crusher comprising at least a first crushing blade and a second crushing blade which are arranged to be rotary, the second crushing blade being also arranged to move back and forth along a linear path, and the rotating axes of the first crushing blade and the second crushing blade being parallel with the linear direction of movement of the second crushing blade, wherein the second crushing blade is fitted to move substantially harmonically back and forth along a linear path.

2. The crusher according to claim 1, wherein the crusher also comprises an eccentric shaft to generate the linear movement of the second crushing blade.

3. The crusher according to claim 2, wherein the crusher also comprises a slide fitted to transmit the movement of the eccentric shaft to the second crushing blade.

4. The crusher according to claim 3, wherein the slide is fitted to remain stationary with respect to the eccentric shaft in the direction of the linear movement.

5. The crusher according to claim 3, wherein the slide is fitted to allow the movement of the eccentric shaft in a direction perpendicular to the direction of the linear movement.

6. The crusher according to claim 1, wherein the diameter of the lower part of the second crushing blade is greater than the diameter of the upper part.

7. The crusher according to claim 1, wherein the diameter of the lower part of the second crushing blade is smaller than the diameter of the upper part.

8. The crusher according to claim 1, wherein the crusher also comprises control cylinders for adjusting the crusher during its operation.

9. A method for crushing material, in which method the material is introduced between a first rotary crushing blade and a second rotary crushing blade, and the second crushing blade moving linearly back and forth with respect to the first crushing blade, and the rotation axis of the crushing blades being parallel to the linear direction of movement, wherein the back-and-forth movement is substantially harmonic.

10. The method according to claim 9, wherein the harmonic linear movement is generated by means of an eccentric shaft.

11. The method according to claim 10, wherein the movement of the eccentric shaft is transmitted to the second crushing blade by means of a slide which remains stationary with respect to the eccentric shaft in the direction of the linear movement, and which allows the movement of the eccentric shaft in relation to the slide in a direction perpendicular to the direction of the linear movement.

12. The method according to claim 9, wherein the mutual setting between the first crushing blade and the second crushing blade is adjusted during the operation by control cylinders.

13. The method according to claim 9, wherein at least the rotation speed of the first crushing blade is adjusted.

14. A method for controlling a crusher, the crusher comprising at least a first crushing blade and a second crushing blade which are arranged to be rotary, the second crushing blade being also arranged to move back and forth along a linear path, and the rotating axes of the first crushing blade and the second crushing blade being parallel with the linear direction of movement of the second crushing blade, wherein in the method, the second crushing blade is adjusted to move along a linear path substantially harmonically.

15. The method according to claim 14, wherein the setting of the crusher is also adjusted by control cylinders.

* * * * *